US009187954B1

(12) United States Patent
Parsons

(10) Patent No.: US 9,187,954 B1
(45) Date of Patent: Nov. 17, 2015

(54) ANGLE CONFIGURING STABILIZING ASSEMBLY FOR EXTENSION LADDERS

(76) Inventor: Andrew S. Parsons, Jeffersonville, NY (US)

( * ) Notice: Subject to any disclaimer, the term of this patent is extended or adjusted under 35 U.S.C. 154(b) by 641 days.

(21) Appl. No.: 12/657,408

(22) Filed: Jan. 20, 2010

Related U.S. Application Data

(60) Provisional application No. 61/205,968, filed on Jan. 26, 2009.

(51) Int. Cl.
*E06C 7/42* (2006.01)
*E06C 7/48* (2006.01)

(52) U.S. Cl.
CPC ..... *E06C 7/48* (2013.01)

(58) Field of Classification Search
CPC ..... E06C 7/423; E06C 7/46; E06C 7/48
USPC ..... 182/172, 107
See application file for complete search history.

(56) References Cited

U.S. PATENT DOCUMENTS

| | | | | | |
|---|---|---|---|---|---|
| 1,496,201 | A | * | 6/1924 | Baxter | 182/22 |
| 1,735,992 | A | * | 11/1929 | Bode | 182/104 |
| 2,275,687 | A | * | 3/1942 | Schubert | 355/63 |
| 2,574,286 | A | | 11/1951 | Rein | |
| 3,878,917 | A | * | 4/1975 | McBride | 182/172 |
| 4,147,231 | A | * | 4/1979 | Chantler et al. | 182/172 |
| 4,519,477 | A | * | 5/1985 | Ralston | 182/107 |
| 4,554,994 | A | * | 11/1985 | Weiner | 182/18 |
| 4,565,262 | A | * | 1/1986 | Hawkins | 182/116 |
| 4,632,220 | A | * | 12/1986 | Murrell | 182/111 |
| 4,641,729 | A | * | 2/1987 | Beck et al. | 182/172 |
| 4,899,849 | A | * | 2/1990 | Levi et al. | 182/172 |
| 4,949,809 | A | * | 8/1990 | Levi et al. | 182/172 |
| 4,964,488 | A | * | 10/1990 | Stewart | 182/172 |
| 5,267,631 | A | * | 12/1993 | Mendel | 182/107 |
| 5,423,397 | A | | 6/1995 | Boughner | |
| 5,868,222 | A | * | 2/1999 | Charbonneau | 182/172 |
| 6,167,989 | B1 | | 1/2001 | Jung | |
| 6,527,084 | B2 | * | 3/2003 | Hrincu | 182/172 |

(Continued)

FOREIGN PATENT DOCUMENTS

EP 84305669.8 2/1986

OTHER PUBLICATIONS set. (n.d.) The American Heritage® Dictionary of the English Language, Fourth Edition. (2003). Retrieved Nov. 12, 2014 from http://www.thefreedictionary.com/set.*

*Primary Examiner* — David E Allred
*Assistant Examiner* — Candace L Bradford
(74) *Attorney, Agent, or Firm* — Sandra M. Kotin

(57) ABSTRACT

A ladder stabilizing assembly for extension ladders has two length adjustable legs attached to opposing sides of the ladder at substantially the midpoint of the working distance of the ladder and two length adjustable braces attached to opposing sides of the ladder near the bottom and are securely attached to the legs. Rods through the hollow rungs attach the legs and braces to the ladder. Heim joints at one end of each leg and brace attach securely to the rods and enable the legs and braces to pivot and swivel for optimum stability placement. The ladder and stabilizer function as a single unit with a wide four point base. The legs and braces are calibrated to assist in setting the ladder at the standard angle for safe use. The stabilizing assembly prevents the ladder from sliding, tipping or other movement and enables the user to work wearing a safety harness.

3 Claims, 5 Drawing Sheets

(56) References Cited

U.S. PATENT DOCUMENTS

| | | | | |
|---|---|---|---|---|
| 7,093,690 | B2 * | 8/2006 | Swann | 182/172 |
| 7,216,742 | B2 * | 5/2007 | Spengler | 182/172 |
| 7,367,425 | B2 * | 5/2008 | Rivers et al. | 182/93 |
| 2001/0015303 | A1 * | 8/2001 | Laug | 182/107 |
| 2005/0115161 | A1 * | 6/2005 | Duke | 52/12 |
| 2005/0197200 | A1 * | 9/2005 | Port et al. | 473/261 |
| 2005/0279575 | A1 * | 12/2005 | Fougere et al. | 182/18 |
| 2006/0000676 | A1 * | 1/2006 | Ramirez | 182/172 |
| 2006/0207830 | A1 * | 9/2006 | Gray et al. | 182/18 |
| 2008/0029341 | A1 * | 2/2008 | Cooper | 182/107 |
| 2011/0067954 | A1 * | 3/2011 | Deal | 182/107 |
| 2011/0147121 | A1 * | 6/2011 | Potter | 182/107 |
| 2012/0103727 | A1 * | 5/2012 | Ramirez | 182/172 |
| 2012/0168253 | A1 * | 7/2012 | McMurray | 182/172 |

* cited by examiner

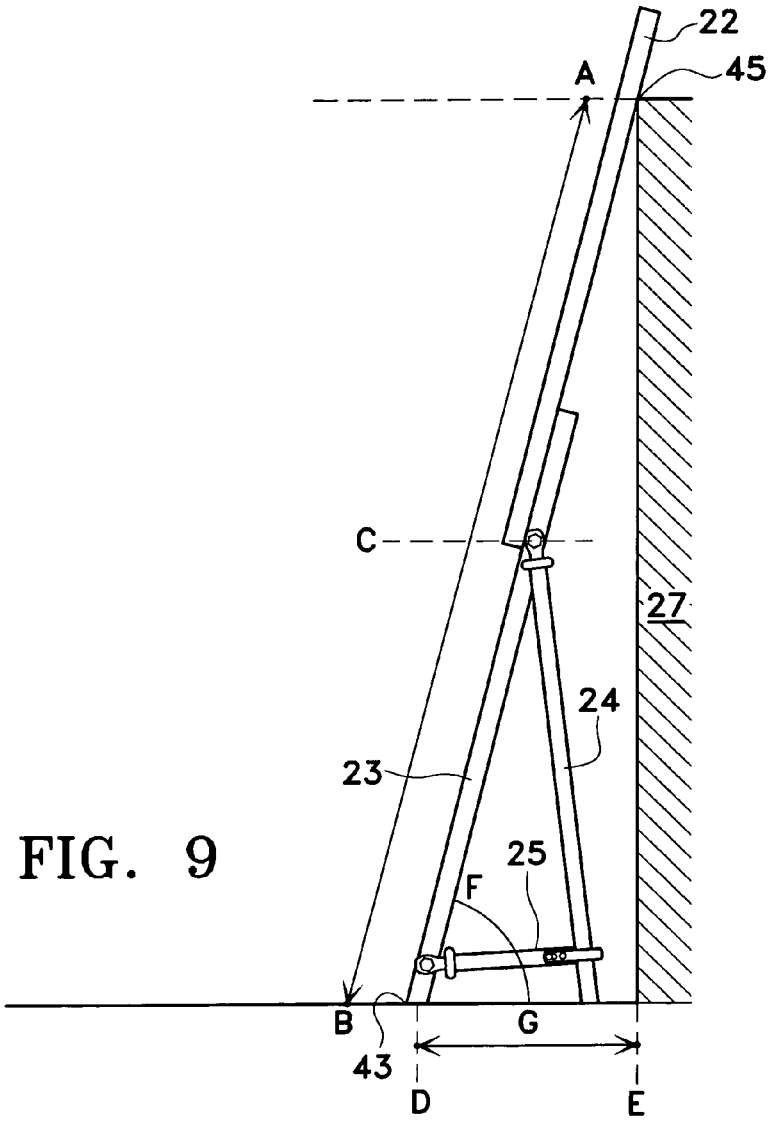
FIG. 9
FIG. 10
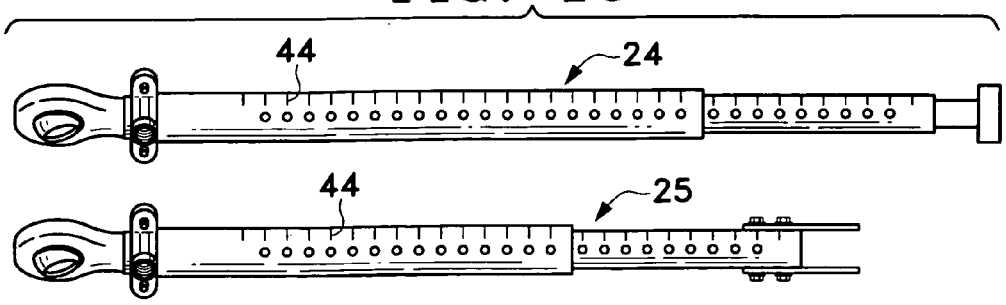

ANGLE CONFIGURING STABILIZING ASSEMBLY FOR EXTENSION LADDERS

This application discloses substantially the same invention disclosed in Provisional Patent Application Ser. No. 61/205,968 filed on Jan. 26, 2009.

FIELD OF THE INVENTION

The instant invention relates to a stabilizer assembly for extension ladders that prevents lateral movement and tipping, prevents the bottom of the ladder from sliding outward from the vertical supporting structure, further prevents weight bearing distortion, and enables setting the ladder at the proper recommended angle for optimum performance and safety.

BACKGROUND OF THE INVENTION

Ladder accidents are some of the most preventable in the building and construction industry. There have been a number of devices developed to prevent ladders from being displaced from their setting during use. Many of these attach to the sides of the ladder and provide lateral support. These devices are usually attached to the lower portion of the ladder rails and do not prevent slippage or bending due to weight bearing. Such lateral stabilizers are taught in U.S. Pat. Nos. 6,167,989; 4,147,231; 4,519,477; and 5,423,397.

A European Patent discloses a stabilizer for an extension ladder having laterally extendable side legs of fixed length that are attached to the upper end of the lower segment of an extension ladder with brackets affixed to the outside of the rails. The brackets are U-shaped and have a series of holes permitting the legs to be set at several points along the brackets. Lower braces are also fixed at one end to the ladder using U-shaped brackets that enable the braces to pivot and at the other end to the lower portion of each leg. This system provides only lateral support. (App. No. 84305669.8 to Ralston)

In U.S. Pat. No. 2,574,286, Rein teaches a ladder brace consisting of two backward facing horizontal struts, one end of each being bolted to the inside of the lower ends of each of the rails. The other end of each strut is pivotally connected to a longer support strut with slots along its upper end and a pivoted shoe at the bottom. The slots can be set by cooperation with the lowest rung of the ladder. The slot chosen determines the angle of lean of the ladder which may not conform to present safety standards. This system is not practical with long extension ladders. The supports of Rein are also situated too low on the ladder to provide real stability or to prevent any weight bearing distortion.

Hawkins, in U.S. Pat. No. 4,565,262, teaches a ladder assembly and stabilizer that can be added to an extension ladder using two posts passing through two of the hollow rungs. The upper post is placed near the top of the lower segment of the extension ladder and the lower post is placed near the midpoint of the lower segment. A leg is affixed to each side of the upper post in such a manner that the legs can extend laterally and to the back of the ladder. One of end of a telescoping strut is pivotally attached to each end of the lower post with its other end attached to the approximate midpoint of a leg by means of a hook. There are two cross struts or braces, also telescoping, attached at one end near the top of each leg and at the other end to the midpoint of the leg using the same hook. Each leg can be set at a different angle and the assembly can fold against the ladder rails for storage. Extensions at the end of each leg can be adjusted for uneven terrain. The hook connectors, though enabling a three-point connection, are open and do not appear sufficient to hold the system together under the stress of repeated use.

A ladder stabilizer for step ladders is described by Stewart in U.S. Pat. No. 4,964,488. Brackets are attached to the ladder rails at a point just below the foldable support strut of the ladder and at a point just below the bottom rung on each rail. A leg is attached to each upper bracket by hinges and a brace is similarly attached at one end to a lower bracket and at the other end to a leg. Neither the legs or the braces are adjustable. The hinges permit the legs to swing about an arc of 230° from the plane of the rails around to the front of the opposing rail. The legs cannot extend behind the ladder and appear to provide lateral support only.

Murrell discloses a safety extension ladder having ratcheted extendable legs for adjustment due to uneven terrain and a support system attached to the lower end of the first segment of the ladder. The support system is made up of outriggers having an upper leg and a lower leg that meet at a pivoted foot. The upper leg is pivotally attached below the midpoint of the lower segment of the ladder by means of a bracket bolted to the rail, and the lower leg is pivotally attached to a frame at the bottom of the ladder. The outriggers can rest on the ground at a range of angles as well as to the side and behind the ladder and can also be raised above the ground to support the ladder against a vertical surface. They fold for storage. The outriggers are not adjustable in length and are permanently attached to the ladder and fixed at its lower end. (U.S. Pat. No. 4,632,220)

The ladder stabilizer of Levi et al. as disclosed in U.S. Pat. No. 4,899,849 supports an extension ladder using two height adjustable legs set into U-shaped brackets attached to the outside of the upper end of each rail of the lower segment of the ladder. The brackets fix the angles of the legs at 45° back from the plane of the ladder rails. A brace on each side extends from about the midpoint of each rail to a leg. Neither the angle nor the lengths of the braces are adjustable, thus fixing the angle of incline of the ladder. The braces are located at too high a level to prevent the ladder from sliding backward from the vertical support structure. In a subsequent patent Levi et al. uses side braces attached near the bottom of the rails and a ratcheted leg extension that can be securely set in place to fix the length of the legs. The side braces are foldable but not length adjustable. (U.S. Pat. No. 4,949,809)

Hrincu uses a pivot bar passed through a hollow rung at about the midpoint of a straight non-extendable ladder. Brackets on each side of the pivot bar hold adjustable length legs that provide the support. Crossed struts further enforce the legs. Cords or wires prevent the legs from extending more than a fixed distance back from the ladder. This system appears to be very flimsy and the legs cannot move laterally. (U.S. Pat. No. 6,527,084)

All of the ladder stabilizers that are attached to the ladder by means of brackets bolted to the side rails require the drilling of holes into the rails to attach the brackets. These holes can weaken the rails and damage the integrity of the ladder thereby interfering with the manufacturer's requirements to comply with statutory safety specifications.

There is a need for a ladder stabilizing assembly for extension ladders that is fully adjustable both in the legs and the braces and one that does not require drilling holes into the rails. There is a need for a ladder stabilizing assembly that can be set at the proper angle for safety and can provide support for heavy loads that would cause an unsupported ladder to bend or distort. There is a need for a ladder stabilizing assembly that makes the ladder sufficiently stabile and tip proof so as to enable the user to wear a safety harness while working on the ladder.

BRIEF SUMMARY OF THE INVENTION

The present invention provides a fully adjustable ladder stabilizer assembly for extension ladders. The stabilizer legs and the lower braces can be attached to the ladder through any hollow rung. Special joints enable the legs to extend back and to the sides of the rails over a substantial arc to enable maximum stability. The adjustability of both the legs and the braces permit the ladder to be used and fully supported at the recommended angle range of 72° to 75.5°. The legs and braces are calibrated to assist in attaining the recommended angle.

It is an object of the present invention to provide a stabilizing assembly that virtually prevents an extension ladder from being displaced once properly set in place so as to virtually eliminate the risk of death or injury.

It is another object of the present invention to provide a stabilizing assembly that is easily attached to or detached from an extension ladder.

It is a further object of the present invention to provide a stabilizing assembly that can be folded and remain attached to the ladder during transport and storage.

It is a still further object of the present invention to provide a stabilizing assembly that will enable the user to set the ladder at the recommended angle for optimum safety.

Another object of the present invention is to provide a stabilizing assembly that stabilizes the ladder to such an extent that the user can wear a safety harness while working from the ladder.

A still further object of the present invention is to provide a stabilizing assembly capable of supporting the ladder to stand alone without the need for a vertical support structure.

A further object of the present invention is to provide a ladder stabilizing assembly that completely eliminates the bending and distortion of the ladder under weight bearing.

The invention is an angle configuring ladder stabilizing assembly for use with an extension ladder having two segments each composed of parallel side rails, a series of evenly spaced apart hollow rungs and a right side and a left side. The stabilizing assembly comprises two length adjustable legs dimensioned for attachment at substantially a midpoint of a working length of the ladder on the right side and on the left side, the working length being determined as the extension ladder is extended and retracted, The midpoint attachment to support the extension ladder at the midpoint to prevent distortion during use. Each leg has a first end and a second end. There are two length adjustable braces dimensioned to be adapted to half the length of the legs as the legs are positioned at half the working length of the extension ladder for attachment on the right and left sides of the extension ladder at substantially a lowermost rung, each brace having a first end and a second end. There are means for enabling the legs and braces to move freely backward and to the right and left sides of the extension ladder rails, the moving means being disposed on the first end of each leg and on the first end of each brace, the leg and brace on the right side being independently movable from the leg and brace on the left side, means for releasably affixing the moving means disposed on the first end of each leg to the right and left sides of the extension ladder at substantially the midpoint of the working length, means for releasably affixing the moving means disposed on the first end of each brace to the right and left sides of the extension ladder at substantially the lowermost rung, means for attaching the second end of each brace to substantially the second end of each leg on the same side of the extension ladder, and means for providing additional support to the second end of each brace at the attachment of the second end of each brace to the substantially second end of each leg on the same side of the extension ladder. The ladder stabilizing assembly in combination with the extension ladder function as a single stable unit so that the extension ladder cannot distort or slide, tip or move in relation to a vertical support.

The invention is also an angle configuring ladder stabilizing assembly for use with an extension ladder having two segments each composed of parallel side rails, a series of evenly spaced apart hollow rungs and a right side and a left side, the stabilizing assembly comprises two length adjustable legs for attachment to the extension ladder on the right and left sides, the length adjustable legs dimensioned for attachment at substantially a midpoint of a working length of the extension ladder as the extension ladder is extended and retracted, the midpoint attachment to indicate half the working length of the extension ladder and to support the extension ladder at the midpoint, each leg having a first end and a second end, and two length adjustable braces dimensioned to be adapted to half the length of the legs when the legs are positioned at half the working length of the extension ladder for attachment on the right and left sides of the extension ladder at substantially a lowermost rung, each brace having a first end and a second end. There are also means for enabling the legs and braces to move freely backward and to the right and left sides of the extension ladder rails, the moving means being disposed on the first end of each leg and on the first end of each brace and the leg and brace on the right side being independently movable from the leg and brace on the left side. There are also two rods dimensioned to fit through the hollow rungs of the extension ladder and to extend outwardly of the extension ladder rails on each side, a first rod disposed at substantially the midpoint of the working length of the extension ladder and a second rod disposed at substantially the lowermost rung of the extension ladder, the first rod and the second rod accepting the moving means to affix said legs to the first rod and to affix the braces to the second rod, means for releasably securing the moving means to the rods, a bracket assembly affixed to the second end of each brace for providing secure attachment of the brace to substantially the second end of the leg on the same side of the extension ladder and means for providing additional support at the attachment of the second end of each brace to substantially the second end of each leg on the same side of the extension ladder. The legs and braces form an integral part of the extension ladder and function as a single unit therewith so that the extension ladder cannot distort or slide, tip or move in relation to a vertical support.

The instant invention includes an angle configuring ladder stabilizing assembly for use with an extension ladder having a first segment and a second segment each composed of parallel side rails with a series of evenly spaced apart hollow rungs and a right side and a left side, the second segment in slidable cooperation with the first segment such that the length of the extension ladder is extended and retracted to accommodate a work site including a vertical support thereby varying a working length of said ladder, the working length having a midpoint. The ladder stabilizing assembly comprises two length adjustable legs dimensioned for attachment to the extension ladder on the right and left sides at substantially the midpoint of the working length of the extension to support the extension ladder at the midpoint to prevent distortion during use, each leg having a first end and a second end and two length adjustable braces dimensioned to be adjusted to half the length of the legs when the legs are attached to the midpoint of the working length of the extension ladder, the braces for attachment on the right and left sides of the extension ladder at substantially a lowermost rung, each brace having a first end and a second end. There are also means for moving the legs and braces backward and to the right and left sides of the extension ladder rails, the moving means being disposed on the first end of each leg and on the first end of each brace, and the leg and brace on the right side being independently movable from the leg and brace on the left side, two rods dimensioned to fit through the hollow rungs of the extension ladder and to extend outwardly of the extension ladder rails on the right and left sides, a first rod disposed at substantially the midpoint of the working length of the extension ladder and a second rod disposed at substantially the lowermost rung of the extension ladder, the first rod and the second rod accepting the moving means to affix the legs to the first rod and to affix the braces to the second rod, means for releasably securing the moving means to the rods, means for attaching the second end of each brace to substantially the second end of each leg on the same side of the extension ladder, and an additional support for the braces at the attachment of the second end of each brace to substantially the second end of each leg on the same side of the extension ladder. The support comprises an axial bore in the second end of each brace and a horizontal member extending outwardly from the substantially second end of each leg for communication with the axial bore. The legs and braces form an integral part of and function as a single unit with the extension ladder so that the extension ladder cannot distort or slide, tip or move in relation to the vertical support.

Other features and advantages of the invention will be seen from the following description and drawings.

BRIEF DESCRIPTION OF THE DRAWINGS

FIG. 9 is a side view of the ladder with the stabilizing assembly in place for proper orientation against a vertical support;

FIG. 10 is a side view of the leg and brace with calibrations attached for setting proper angle;

DETAILED DESCRIPTION OF THE INVENTION

Figure 1:
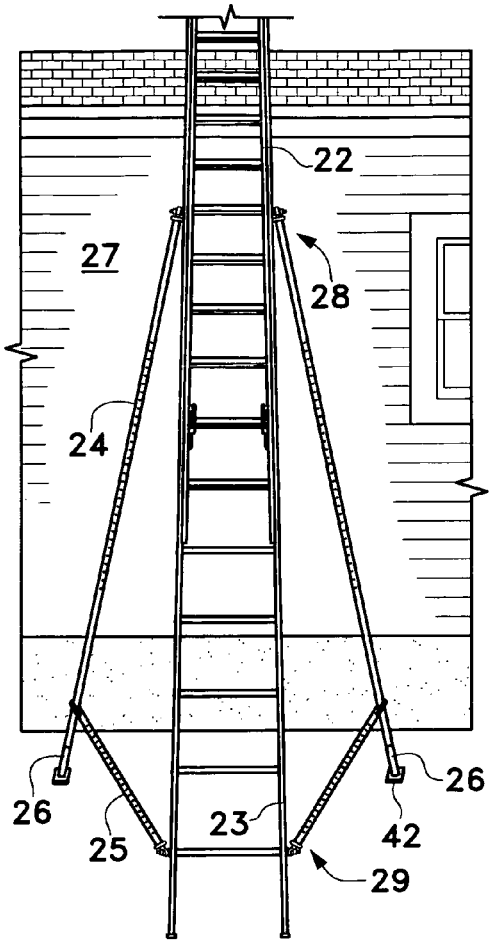
FIG. 1 is a front view of an extension ladder with the stabilizing assembly attached and set for use.

The ladder stabilizing assembly 20 of the present invention may be used with any conventional extension ladder 21 being composed of two segments, each having parallel side rails and a series of hollow rungs placed at regular intervals between the rails. The assembly 20 may support the ladder 21 from any point along its length, but optimum performance may be obtained when the attachment is made at a point that is substantially the midpoint of the working length L of the ladder. The working length L of the ladder is defined as the distance along the ladder between the foot and the top support.

The assembly 20 is made up of two identical support components attached at opposing sides of the ladder 21. The two components are each composed of an adjustable length leg 24 and an adjustable length brace 25. There may be an extension 26 at the bottom of each leg 24 to enable proper adjustment when the ground is not even, with a slip resistant foot 42 at the base of each extension 26. The legs 24 and braces 25 may be attached to the ladder in such a manner that they can pivot and also swivel to provide the best stabilization according to the specific site requirements. Since both of the legs 24 and both of the braces 25 are completely adjustable, each leg 25 may be set at a different length and angle so that the assembly may also be used on a slope or on a stairway. The ability to pivot may also enable the legs 24 and braces 25 to fold against the ladder for transport and storage.

Figure 2:
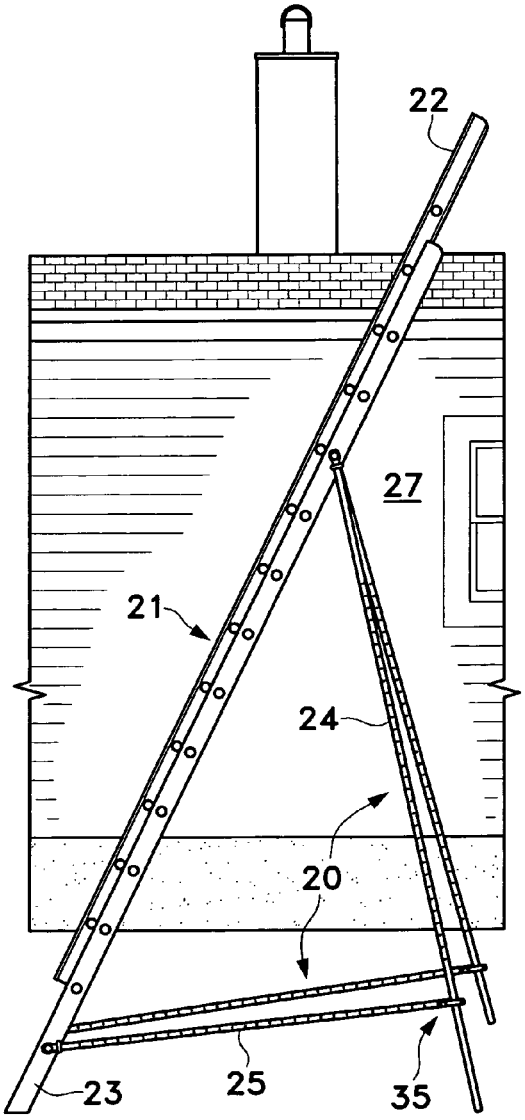
FIG. 2 is a side view of the ladder with stabilizing assembly of FIG. 1.

Once attached to the ladder 21, the legs 24 may be set to extend straight back toward the vertical support 27 against which the ladder is placed. However, a better stabilization may be achieved when the legs 24 are set back and to the side of the ladder 21 as can be seen in FIGS. 1 and 2. This may widen the effective base of the ladder for greatest stability. The angle of offset may be determined according to the condition of the ground underneath and around the ladder but on even terrain the best stability and widest base are achieved when the legs 24 are both set at the maximum angle permitted by the joints used. As noted above, the two legs 24 do not have to be set at the same angles and may be set according to the ground conditions.

Figure 3:
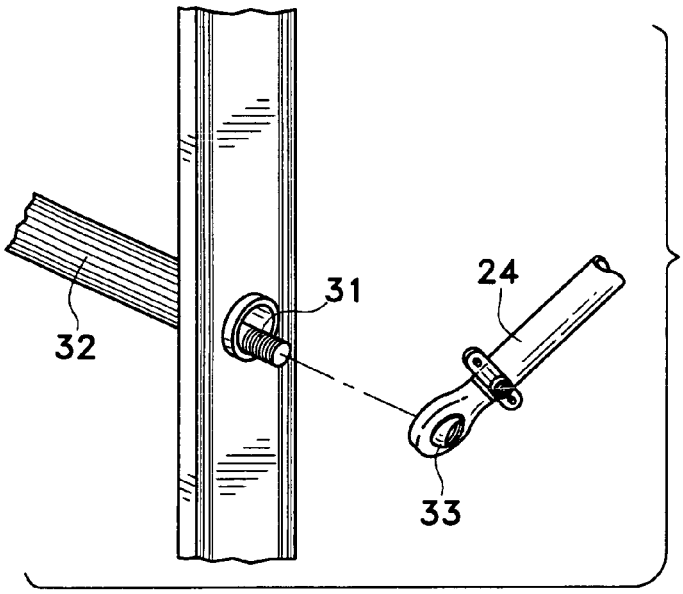
FIG. 3 is an exploded view of the rod disposed within a hollow rung and upper end of leg.
Figure 4:
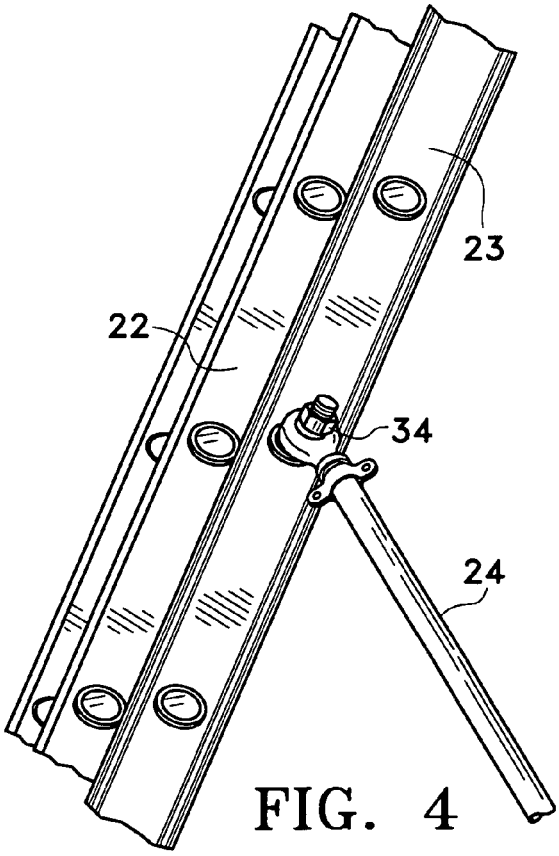
FIG. 4 is a side perspective view of the leg attached to the rod of FIG. 3.
Figure 5:
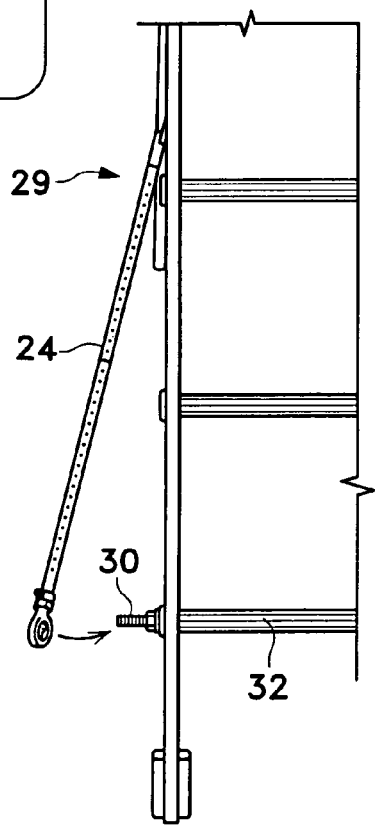
FIG. 5 is a front view of the leg attached at the upper portion of the ladder and the lower rod in place to receive the brace.
Figure 6:
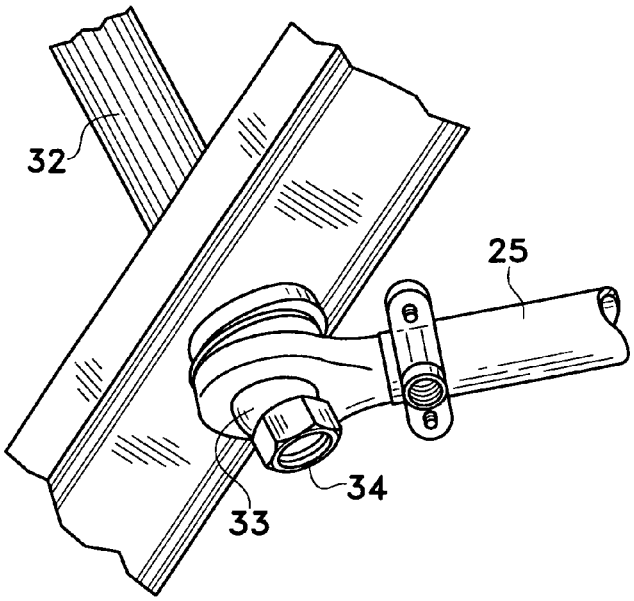
FIG. 6 is a close up perspective view of the attachment of the leg to the rod with the Heim joint to permit a range of movement.

The legs 24 and braces 25 may be attached to the ladder by means of rods 30 that that may be passed through any of the hollow rungs 32 of the ladder 21. See FIGS. 3 and 5. Both ends of the rods 30 may be threaded. The rods 30 may be dimensioned such that the threaded ends 31 may extend outward of the hollow rung 32 on both sides of the ladder 21. A Heim joint 33 may be affixed to the upper end 28 of each leg 24 and the inside end 29 of each brace 25. Other means known in the art that permit the legs and braces to both pivot and swivel may be used. The threaded ends 31 of the rods 30 may pass through the Heim joints 33 and be retained by cooperating nuts 34. (FIGS. 4 and 6) When the nuts 34 are properly tightened the two legs 24 and rod 30 may be locked together and perform as one unit and the rod 30 cannot rotate. The legs 24 may pivot and/or swivel by means of the Heim joints 33 to achieve the proper setting. The outer ends of each 35 of the two braces 25 may be tightly fastened to the lower rod 30 and may also function as one unit. Once the outer ends 35 of the braces 25 are attached to the legs 24, as described below, the entire system, assembly 20 and ladder 21, may function together and perform as a single stable unit. For extension ladders that may not have hollow rungs, adapters may be used to connect the stabilizing assembly to the ladder.

Figure 7:
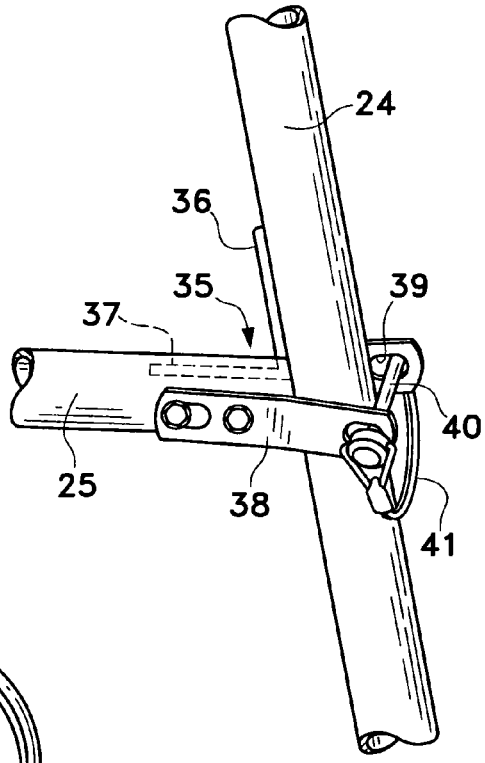
FIG. 7 is a side perspective view of the attachment of the brace to the leg.
Figure 8:
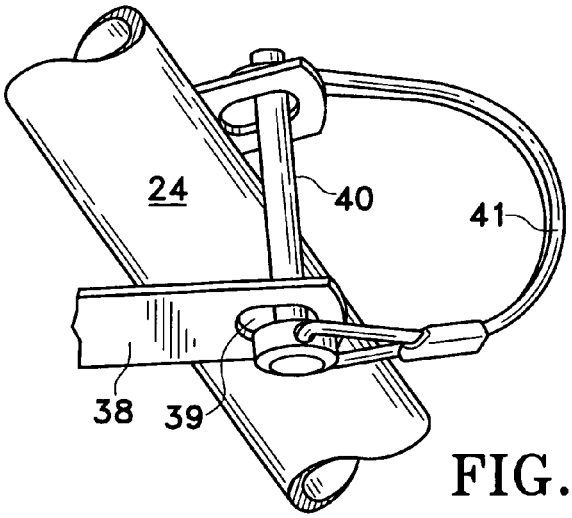
FIG. 8 is close up of the pin clamp also visible in FIG. 7.

The outer end 35 of the brace 25 may be securely attached to the lower portion of the leg 24. An L-shaped bracket 36 may be affixed to the lower portion of the leg 24 on its inside surface so that the projection 37 of the "L" may extend outward at a substantially 90° angle toward the ladder 21. The outer end 35 of the brace 25 may be hollow or may have an axial opening to receive the projection 37 as may be seen in FIG. 7. There may be a straight bracket 38 with an opening 39 at the end attached to each side of the outer end 35 of the brace 25. The brackets 38 may extend well beyond the outer end 35 of the brace 25. When the brace 25 is joined to the leg 24, the hollow end of the brace 25 may receive the L projection 37 and the leg 24 may be situated between the two straight brackets 38. A pin 40 may be passed through the openings 39 in each bracket 38 and may be retained in place by a pin clamp 41 as seen in FIGS. 7 and 8. This attachment may not only maintain the brace 25 in cooperation with the leg 24, but the L projection 37 may provide additional support to the brace 25 to further insure that the system is secure even when the ladder 21 is used to support considerable weight.

The situating of the legs 24 at the midpoint of the working length or at a high point on the ladder 21 and the adjustability of the legs 24 and braces 25 may permit the stabilizing assembly 20 to be set at the proper orientation to provide sufficient stability so that the ladder may be used without being supported by a vertical support or wall 27, i.e., the ladder may be free standing. This may be advantageous at times when it may be easier for the user to get closer to the work surface when the ladder 21 is placed along side the wall 27 as seen in FIG. 2 instead of leaning against the wall 27 as seen in FIG. 1.

Figure 12:
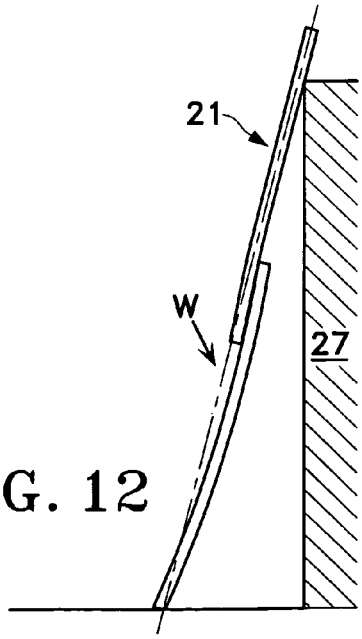
FIG. 12 is a side view of an extension ladder showing distortion under an applied weight.
Figure 13:
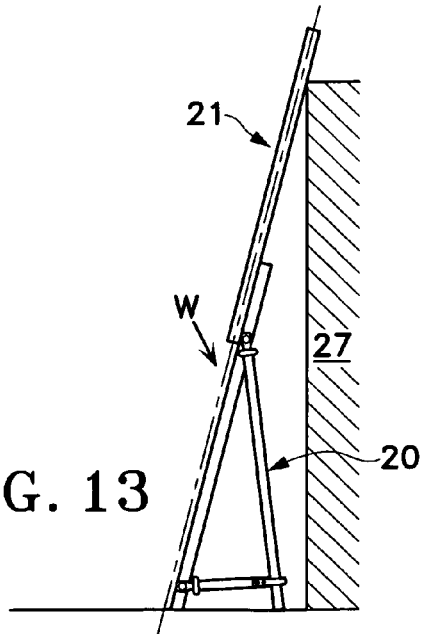
FIG. 13 is a side view of an extension ladder with the stabilizing assembly showing no distortion under an applied weight.

Extension ladders will bend or distort when supporting weight, often just the weight of the climber as seen in FIG. 12. The longer the extended portion of the ladder, the more bending may occur which may cause the ladder to vibrate and slide or tip as the person climbs higher. This distortion may be further exacerbated when the climber carries building materials which increase the weight being supported on the ladder. The stabilizing assembly 20 of the present invention may completely prevent any bending or distortion as can be seen in FIG. 13. With the assembly 20 in place, each segment of the ladder may be well supported. This may not only make the ladder safer, but it may also take away the apprehension often experienced when a worker climbs a long extension ladder. With the assembly 20 of the present invention properly affixed to an extension ladder 21 there may never be the need for a coworker to help support the bottom of the ladder as is now often necessary, though ineffectual, when a worker must climb to a high point.

Figure 11:
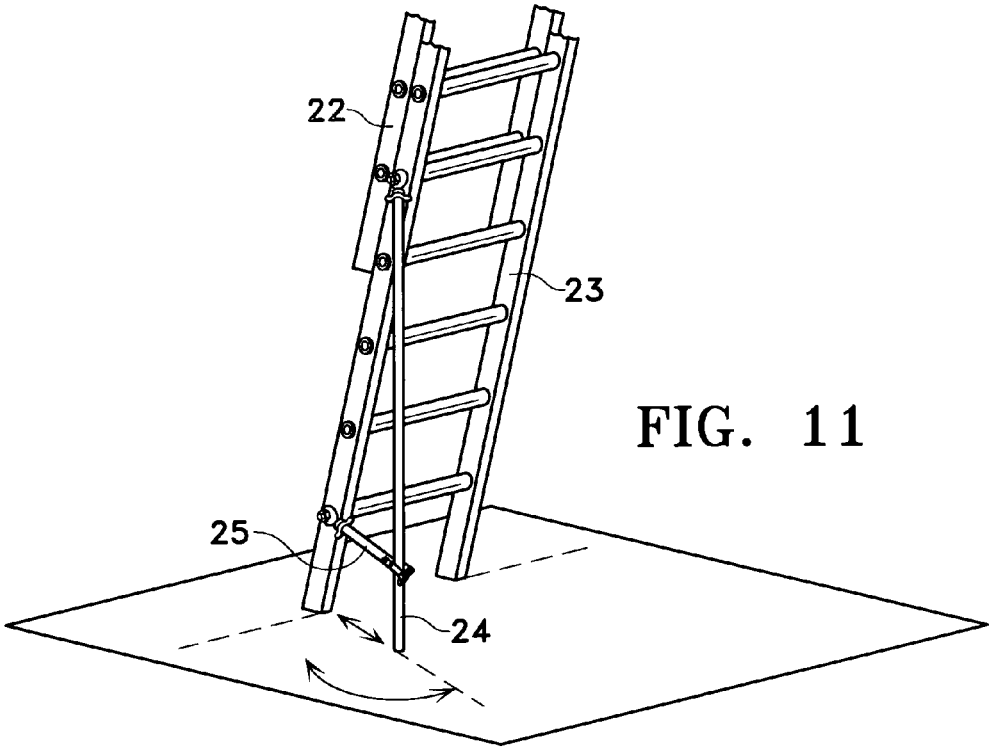
FIG. 11 is rear perspective view of a portion of the ladder and stabilizing assembly illustrating the range of movement of the leg and brace.

There are three basic causes of accidents in the construction industry that may be attributed to ladders, i.e., side to side or lateral movement, movement at the top of the ladder where it meets the vertical support, and displacement at the bottom which may be due to the weight of the user, surface conditions, or vibrations which may increase as the worker climbs to a higher level. The fixed four point base resulting when the stabilizing assembly 20 is attached to the ladder 21 may eliminate all of these problems. The length adjustability of both the legs 24 and the braces 25 and their ability to be set at an angle toward the side and back of the ladder, as seen in FIG. 11, creates a wider and more stabile base thereby greatly increasing the safety of the user.

Federal and state laws require that workers assigned to work in high places wear safety harnesses, with the exception of workers on ladders. If a worker is on a ladder with a harness and falls, the ladder will also fall, usually on the worker. A strong safety factor of the present invention may be the fact that an extension ladder 21 with the stabilizing assembly 20 properly attached cannot sway or topple. Therefore, workers perched on such a ladder may wear a safety harness. Should the worker lose his footing and fall, the harness will hold to the ladder and the worker will be supported by the harness and the ladder. The ladder cannot tip, slide or topple. The safety stabilizing assembly 20 of the present invention may make it possible for all workers using extension ladders to be protected by a safety harness.

Ladder accidents account for a substantial proportion of the injuries and deaths in the building and construction industries. As a result the Occupational Safety and Health Administration (OSHA) has promulgated standards for the use of ladders which can be found in 29 C.F.R. §1926 et seq., titled "Safety and Health Regulations for Construction." The regulations very clearly state the optimum angle at which extension ladders must be set for safe use. The pitch of the ladder must be 75.5° measured from the horizontal, angle F-G in FIG. 9. This angle may be achieved by noting that the horizontal distance (S), line D-E, from the vertical support 27 to the foot of the ladder should be Vs the working length (L), line A-B, of the ladder. These distances may be seen in FIG. 9. Thus, if the working length of a ladder is 24 feet, the foot of the ladder should be placed 6 feet from the base of the vertical support 27. Put another way, the set back (S) must be 1 foot for each 4 feet of working length (L).

Though construction workers may be advised as to the proper angle to set the extension ladder, it is not something they are going to measure. The leg 24 and brace 25 of the instant invention may be marked in calibrations 44 of, for example, 3 in (8 cm) or 6 in (15 cm), to assist in setting the base of the ladder at the optimum distance from the wall, thereby achieving the proper angle. Before being attached to the ladder the stabilizing assembly may be used to establish the proper distance from the foot of the ladder to the support. Once the ladder is raised and set in place against the vertical support 27, the worker may estimate the working length from the overall length of the ladder. He may then select the rung closest to the midpoint of the working length (point C in FIG. 9). This may be determined by sight or by counting the rungs between the foot of the ladder 43 and the support point 45, i.e., where the ladder 21 meets the vertical support 27. The standards for ladders set the distance between the rungs of the ladder as not less than 10 in (25 cm) nor more than 14 in (36 cm). Therefore gauging the working length and the midpoint of the working length L by counting the rungs may come substantially close to the actual distances.

The threaded rod 30 for the leg 24 may be inserted into the rung 32 closest to the midpoint of the working length of the ladder 21 and the two legs 24 loosely attached to the rod 30. One leg 24 may then be extended downward along the ladder until it reaches the foot 43. One brace 25 may then be adjusted to ½ the length of the leg 24. The brace 25 may then be set on the ground with one end against the wall or other vertical support 27. If the ladder was placed at the proper angle the other end of the brace 25 will be against the foot 43 of the ladder 21. If it is not, the foot 43 of the ladder 21 can be moved to touch the end of the brace 25. This may alter the estimated working length of the ladder slightly, but for an experienced worker, this difference should be small so that the ladder will be within the suggested range of pitch. If the distance from the wall to the foot of the ladder is considerably greater then the set length of the brace, the ladder can be moved accordingly and the midpoint reset. The nuts 34 retaining the legs 24 may be tightened and the installation of the remaining parts of the stabilizing assembly may then be completed so the ladder will be ready for use. This whole process should take no more then a few minutes. Using this method to set the ladder at the proper distance from the supporting structure may eliminate human error and insure that the ladder is set at or very close to the optimum working angle.

Each of adjustable legs 24 and braces 25 may be made up of two nested hollow tubes having a series of through openings placed at specific intervals. They may be extended as needed and set in place by a spring controlled button, a pin that passes through both tubes and may be fastened in place, or other methods known in the art. The pin method may be best because it may be more capable of sustaining the considerable weight to which the ladder may be subjected. The calibrations 44 may be put on the legs and braces by etching, printing, or applying calibrated tape. See FIG. 10.

The various parts of the stabilizing assembly may be constructed of aluminum, fiberglass, or a strong polymeric material. Since the assembly can be folded against the ladder, clips or cords may be used to hold the legs 24 and braces 25 against the rails of the ladder during transport and storage. The stabilizing assembly may also be easily removed from one ladder and installed on another ladder in a matter of minutes.

While one embodiment of the present invention has been illustrated and described in detail, it is to be understood that this invention is not limited thereto and may be otherwise practiced within the scope of the following claims.

This parts list if for examination purposes only and should not be published with the patent.

PARSONS PARTS LIST

20 Stabilizing assembly
21 Extension ladder
22 Upper segment
23 Lower segment
24 Leg
25 Brace
26 Extension foot
27 Vertical support—wall
28 Upper end of leg
29 Inside end of brace
30 Rod
31 Threading
32 Hollow rung
33 Heim joint
34 Bolt
35 Outer end of brace)
36 L-shaped bracket
37 Projection
38 Straight bracket
39 Opening in straight bracket
40 Pin
41 Pin clamp
42 Slip resistant foot
43 Foot of ladder
44 Calibrations
45 Support point
46
47
48
49
50

I claim:

1. An angle configuring ladder stabilizing assembly for use with an extension ladder having two segments each composed of parallel side rails and a series of evenly spaced apart hollow rungs, said stabilizing assembly comprising:

two length adjustable legs dimensioned for attachment on opposing sides of the extension ladder at substantially a midpoint of a working length of the extension ladder, said midpoint being indicative of substantially half the working length of the extension ladder, each leg having a first end and a second end;

two length adjustable braces, each brace having a first end and a second end, and dimensioned to be adapted to half the length of the legs as the legs are adapted to half the working length of the extension ladder to configure an angle of the extension ladder and for attachment of said first end of each brace on opposing sides of said extension ladder at substantially a lowermost rung thereof;

means for enabling the legs and braces to pivot and swivel backward and to the opposing sides of the extension ladder rails, said pivot and swivel means comprising a ball and socket disposed on the first end of each leg and on the first end of each brace;

means for detachably affixing the pivot and swivel means disposed on the first end of each leg to the opposing sides of the extension ladder at substantially the midpoint of the working length thereof, said means for detachably affixing the pivot and swivel means comprising a first rod extending through a rung at substantially the midpoint of the working length of the extension ladder and first and second ends of the first rod engaging a respective ball of the ball and socket on the respective leg means for detachably affixing the pivot and swivel means disposed on the first end of each brace to the opposing sides of the extension ladder at substantially the lowermost rung thereof, said means for detachably affixing the pivot and swivel means comprising a second rod extending through the lowest rung and first and second ends of the second rod engaging a respective ball of the ball and socket on the respective brace;

means for attaching the second end of each brace to substantially the second end of each leg on the same side of the extension ladder; and means for providing additional support to the second end of each brace at the attachment of the second end of each brace to the substantially second end of each leg on the same side of the extension ladder;

whereby the ladder stabilizing assembly in combination with the extension ladder function as a single stable unit so that the extension ladder cannot slide, tip or move in relation to a vertical support.

2. An angle configuring ladder stabilizing assembly for use with an extension ladder having two segments each composed of parallel side rails and a series of evenly spaced apart hollow rungs, said stabilizing assembly comprising:

two length adjustable legs for attachment to the extension ladder on opposing sides, said length adjustable legs dimensioned for attachment at substantially a midpoint of a working length of the extension ladder as said extension ladder is extended and retracted, said midpoint to indicate substantially half the working length of the extension ladder and to support the extension ladder at said midpoint, each leg having a first end and a second end;

two length adjustable braces, each brace having a first end and a second end, and dimensioned to be adapted to half the length of the legs when the legs are adapted to substantially half the working length of the extension ladder to configure an angle of the extension ladder and for attachment of said first end of each brace on opposing sides of said extension ladder at substantially a lowermost rung thereof;

means for enabling the legs and braces to pivot and swivel backward and to the opposing sides of the extension ladder rails, said pivot and swivel means comprising a ball and socket disposed on the first end of each leg and on the first end of each brace, said pivot and swivel means including a first rod extending through a rung at substantially the midpoint of the working length of the extension ladder and first and second ends of the first rod engaging a respective ball of the ball and socket on the respective leg, and said pivot and swivel means including a second rod extending through the lowest rung and first and second ends of the second rod engaging a respective ball of the ball and socket on the respective brace;

means for detachably affixing the pivot and swivel means to the rods;

a bracket assembly affixed to the second end of each brace for providing secure attachment of said brace to substantially the second end of each leg on a same side of the extension ladder; and means for providing additional support at the attachment of the second end of each brace to substantially the second end of each leg on the same side of the extension ladder;

whereby, the braces assist in configuring the angle of the extension ladder and thereafter form an integral part of the stabilizing assembly which, in combination with the extension ladder, function as a single unit so that the extension ladder cannot slide, tip or move in relation to a vertical support.

3. An angle configuring ladder stabilizing assembly for use with an extension ladder as described in claim 2 wherein the means for providing additional support at the attachment of the second end of each brace to substantially the second end of each leg comprises:

an axial bore in the second end of each brace; and a horizontal member extending outwardly from substantially second end of each leg at the attachment of the second end of the brace to said second end of the leg on the same side of the ladder;

whereby the horizontal member communicates with the axial bore to provide the additional support to each brace.

* * * * *